US007399145B2

(12) United States Patent
Clark

(10) Patent No.: US 7,399,145 B2
(45) Date of Patent: Jul. 15, 2008

(54) MULTI-LAYER LINER ASSEMBLY FOR A SAND TRAP

(76) Inventor: Kevin L. Clark, 2182 E. Hickory Hill Rd., Argyle, TX (US) 76226

( * ) Notice: Subject to any disclaimer, the term of this patent is extended or adjusted under 35 U.S.C. 154(b) by 499 days.

(21) Appl. No.: 11/188,938

(22) Filed: Jul. 25, 2005

(65) Prior Publication Data

US 2007/0020048 A1 Jan. 25, 2007

(51) Int. Cl.
*E02B 11/00* (2006.01)

(52) U.S. Cl. ..... 405/302.7; 405/258

(58) Field of Classification Search ..... 405/263, 405/302.7

See application file for complete search history.

(56) References Cited

U.S. PATENT DOCUMENTS

| | | | | |
|---|---|---|---|---|
| 4,846,604 | A | 7/1989 | Holtmann | |
| 4,960,345 | A * | 10/1990 | Hurley et al. | 405/38 |
| 5,147,156 | A | 9/1992 | Guettler et al. | |
| 5,256,007 | A | 10/1993 | Allen | |
| 5,263,792 | A | 11/1993 | Davis et al. | |
| 5,460,867 | A | 10/1995 | Magnuson et al. | |
| 5,746,546 | A * | 5/1998 | Hubbs et al. | 405/263 |
| 5,848,856 | A * | 12/1998 | Bohnhoff | 405/36 |
| 6,094,860 | A | 8/2000 | Motz et al. | |
| 6,221,445 | B1 | 4/2001 | Jones | |
| 6,467,991 | B1 | 10/2002 | Joyce et al. | |
| 6,691,472 | B2 | 2/2004 | Hubert | |
| 6,802,669 | B2 | 10/2004 | Ianniello et al. | |
| 6,863,477 | B2 | 3/2005 | Jenkins et al. | |
| 6,877,932 | B2 | 4/2005 | Prevost | |
| 7,001,111 | B2 | 2/2006 | Maxwell et al. | |
| 7,014,390 | B1 | 3/2006 | Morris | |
| 7,114,877 | B2 | 10/2006 | Wilkerson | |
| 7,131,788 | B2 | 11/2006 | Ianniello et al. | |
| 7,207,747 | B1 | 4/2007 | England | |
| 7,309,188 | B2 | 12/2007 | Ianniello et al. | |
| 2002/0137871 | A1 * | 9/2002 | Wheeler et al. | 528/44 |
| 2003/0012604 | A1 | 1/2003 | Fukui | |
| 2004/0131423 | A1 | 7/2004 | Ianniello et al. | |
| 2006/0002764 | A1 | 1/2006 | Legge et al. | |
| 2006/0193703 | A1 | 8/2006 | Ianniello et al. | |

FOREIGN PATENT DOCUMENTS

JP 08041959 A * 2/1996

* cited by examiner

*Primary Examiner*—John Kreck
(74) *Attorney, Agent, or Firm*—Roeder & Broder LLP; James P. Broder

(57) ABSTRACT

A liner assembly (222A) for a sand trap (10) having a perimeter (12) that defines a cavity (13) and a substrate (18) within the cavity (13) includes a first layer (230A) and a second layer (232A). The first layer (230A) is positioned on the substrate (18) and can be formed from a substantially water-permeable material. The second layer (232A) can be formed from a substantially water-impermeable material and is applied to the first layer (230A). The second layer (232A) can be applied to the first layer (230A) as a liquid, such as a polyurea material. In one embodiment, at least one of the layers (230A, 232A) extends within the substrate (18) at least partially outside the perimeter (12) of the sand trap (10). The second layer (232A) can include an aggregate material that is integrally formed as part of the second layer (232A).

34 Claims, 5 Drawing Sheets

MULTI-LAYER LINER ASSEMBLY FOR A SAND TRAP

BACKGROUND

Golf technology is advancing at a rapid pace. Equipment has improved, allowing players to hit golf balls farther than ever before, with greater accuracy. In an attempt to keep up with modern golf technology, new golf courses are being constructed and older courses are being renovated to enhance the level of difficulty. As a result of this effort, the number and size of sand traps has increased.

Unfortunately, sand traps require a substantial amount of maintenance and grooming. For example, because sand traps often are positioned near existing grasses, shrubs or other plantings, growth of these plantings can spread into the sand trap, which may be undesirable on certain types of golf courses. Additionally, sand traps can retain water from precipitation and/or irrigation, resulting in slow drainage and ponding of water within the sand trap. Such adverse conditions can result in frustrated golfers or even unplayable conditions, both of which can cause economic losses for golf course owners.

SUMMARY

The present invention is directed toward a liner assembly for a sand trap. The sand trap typically has a perimeter that defines a cavity, and a substrate at the base and sides of the cavity. The substrate is normally formed from natural materials such as soil, rock, etc. In one embodiment, the liner assembly includes a first layer and a second layer. The first layer is positioned on the substrate and can be formed from a water-permeable material such as a geotextile fabric. The second layer can be formed from a substantially water-impermeable material. In one embodiment, the second layer is applied to the first layer.

In accordance with one embodiment of the invention, the first layer covers at least approximately 10% of the substrate within the cavity. Alternatively, the first layer can cover greater than 10%, and up to 100% of the substrate in the cavity. In one embodiment, the second layer covers at least a majority, and up to 100% of the first layer. Further, the second layer can be applied to the first layer as a liquid. In this embodiment, the second layer can include a polyurea material. Further, because of the liquid application, the second layer can be seamless. In accordance with one embodiment, at least one of the layers extends within the substrate at least partially outside the perimeter of the sand trap.

In an alternative embodiment, the second layer includes an aggregate material that is integrally formed as part of the second layer. The present invention is also directed toward a sand trap that includes a drain line and the liner assembly previously described so that the liner assembly is at least partially positioned between the substrate and the drain line.

The present invention also includes a plurality of methods for constructing a sand trap.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
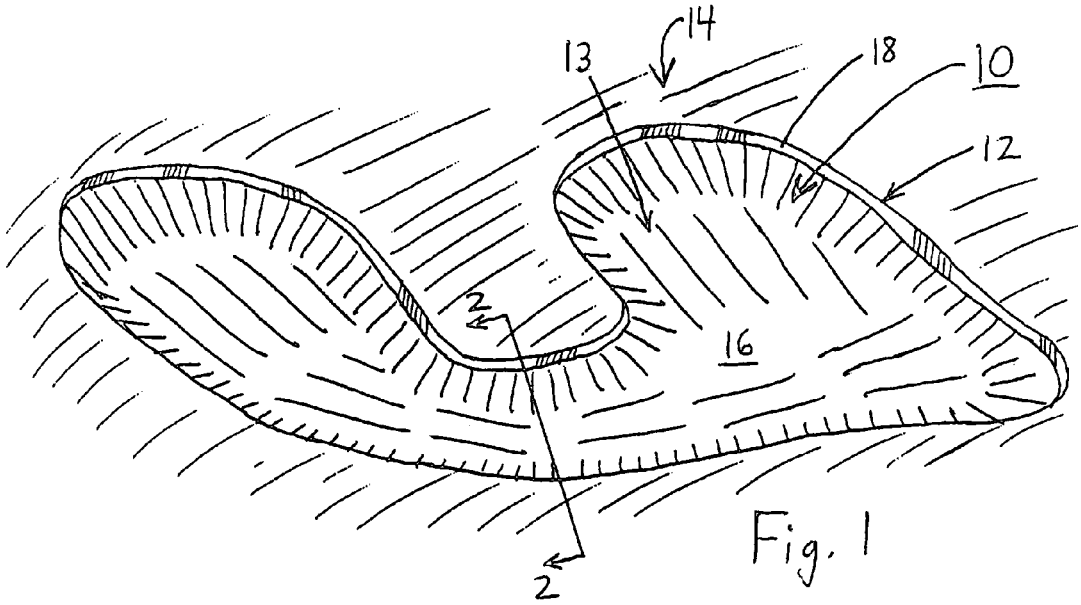
FIG. 1 is a perspective view of a sand trap having features of the present invention.

FIG. 1 is a perspective view of a sand trap 10 having features of the present invention. The sand trap 10 described herein can be used on any type of golf course or any size public or private golf practice facility, as non-exclusive examples. The sand trap 10 illustrated in FIG. 1 has a perimeter 12 that defines a cavity 13 of the sand trap 10, and is cut into the ground surface 14. The perimeter 12 of the sand trap 10 defines the overall shape or configuration of the sand trap 10. The shape of the sand trap 10 illustrated in FIG. 1 is merely one example of an infinite number of possible shapes, and is shown as a representative example only.

In this example, the ground surface 14 can be grass or any other type of vegetation. Further, the ground surface 14 can include soil, rock, or other types of non-vegetative materials. In this embodiment, because the sand trap 10 is cut into the ground surface 14, most or all of the sand trap 10 is positioned substantially at or below the level of the ground surface 14. The sand trap 10 also includes filling material 16 (e.g., sand, quartz, crushed granite or other similar material) and a substrate 18.

Figure 2A:
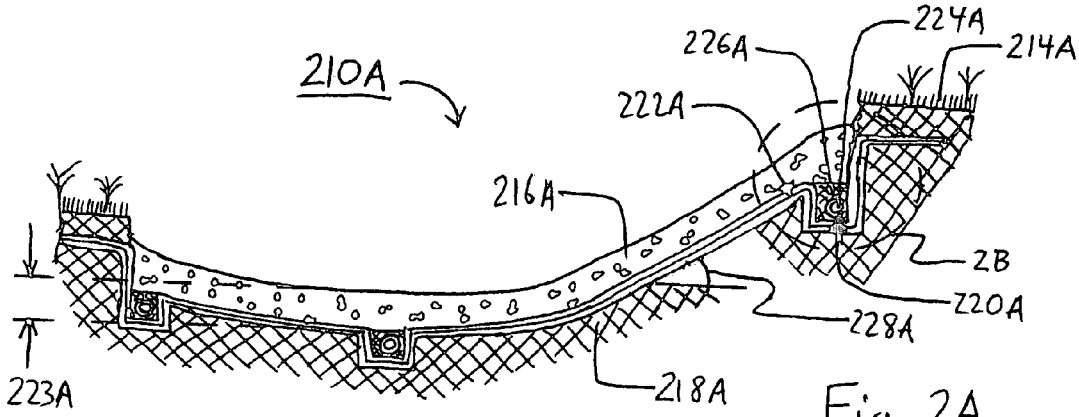
FIG. 2A is a cross-sectional view taken on line 2-2 in FIG. 1, illustrating a first embodiment of a liner having features of the present invention.

FIG. 2A is a cross-sectional view of the sand trap 10 and a portion of the ground surface 14 taken on line 2-2 in FIG. 1. In this embodiment, the sand trap 210A includes filling material 216A (hereinafter referred to as sand), the substrate 218A, a drainage system 220A and a liner assembly 222A. In one embodiment, the sand 216A can have a relatively uniform depth 223A along the length and/or width of the sand trap 210A. For example, the sand 216A can have a depth 223A of approximately two to eighteen inches, although the depth 223A can be above or below the depth 223A within this range. In an alternative embodiment, the depth 223A of the sand 216A can vary within the sand trap 210A.

The substrate 218A is material at the bottom and/or sides of the sand trap 210A that supports the ground surface 214A. The substrate 218A can be formed from any suitable material, including native or imported soils of any type, organic materials, different types of aggregate, various sizes and types of rock, or any other material that forms an appropriate substrate for the remainder of the contents of the sand trap 210A.

In one embodiment, the substrate 218A is formed by carving out or otherwise removing native ground material to form a cavity 13 (illustrated in FIG. 1). In this embodiment, the substrate 218A is the material, i.e. soil, rock, etc., that remains following removal of material to form the cavity 13. In an alternative embodiment, known soil amendments, certain aggregates or other materials can be added to the cavity 13 to form the substrate 218A or combine with the native materials to form the substrate 218A. In yet another embodiment, material is built up to form the desired cavity 13 configuration. Further, the substrate 218A can be compacted to form a relatively solid base for the remaining materials, described below.

The drainage system 220A can include a network of one or more drain lines 224A that are typically used for landscape drainage. For example, the drain lines 224A can include perforated polyvinylchloride (PVC) pipe, with or without geofabric or some other type of sleeve surrounding the pipe. Alternatively, other suitable types of drain lines 224A or area drains can be utilized with the present invention. In one embodiment, the drain lines 224A can be at least partially surrounded by a drain surround 226A such as crushed rock, for example, or other types of aggregates. In certain embodiments, the drain lines 224A can be connected to a drainage outlet 325 (illustrated in FIG. 3), culvert or brow ditch (not shown) or to a sewer system (not shown) that carries the drained fluid away from the sand 216A within the sand trap 210A.

The liner assembly 222A inhibits growth of plants, shrubs, bushes, grass or other vegetation within the sand trap 210A. Further, the liner assembly 222A preserves the integrity of the sand 216A and inhibits infusion and migration of the substrate 218A into the sand 216A. In addition, or in the alternative, the liner assembly 222A directs and/or diverts water to the drainage system 220A to more quickly evacuate water from the sand trap 210A. The design of the liner assembly 222A can be varied depending upon the design requirements of the sand trap 210A.

In the embodiment illustrated in FIG. 2A, the liner assembly 222A extends along the bottom and sides of the sand trap 210A. In this embodiment, the liner assembly 222A is positioned adjacent to the substrate 218A. Stated another way, the liner assembly 222A is substantially covered by the sand 216A and/or the drainage system 220A so that the liner assembly 222A is not visible to golfers. In the embodiment illustrated in FIG. 2A, the majority of the liner assembly 222A is positioned directly or indirectly between the substrate 218A and the sand 216A. Further, a portion of the liner assembly 222A can be positioned within the substrate 218A, as explained in greater detail below.

Further, as described below, because of the materials used and the method of installation, the liner assembly 222A can be installed at various angles 228A that are significantly greater than zero degrees relative to the horizontal. In one embodiment, for example, the angle 228A of the liner assembly 222A can be approximately 45 degrees relative to the horizontal. In non-exclusive, alternative embodiments, the angle 228A of the liner assembly 222A can be at least approximately 10, 15, 20, 30, 60 or 75 degrees relative to the horizontal. In further embodiments, the angle 228A of the liner assembly 222A can be approximately 90 degrees or greater than 90 degrees relative to the horizontal. With this design, as provided below, the liner assembly 222A can inhibit the sand 216A from sliding down to the lower portions of the sand trap 210A despite an increased relative steepness of the sand 216A.

Figure 2B:
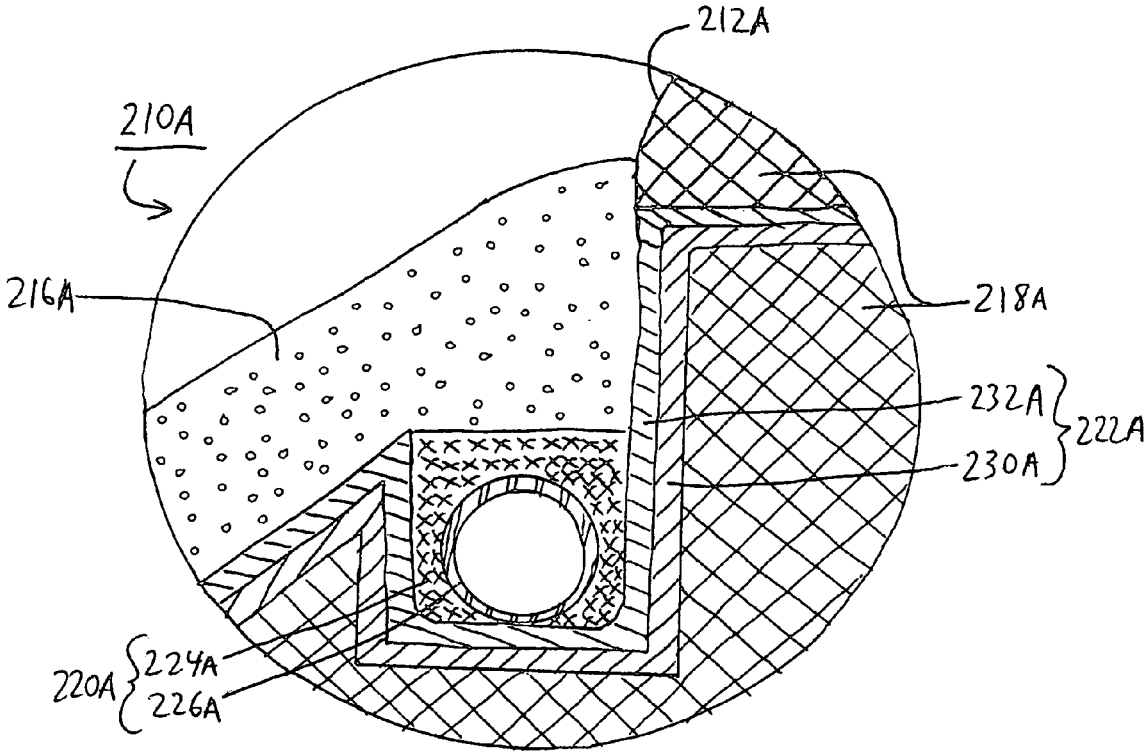
FIG. 2B is a detailed view of a portion of FIG. 2A illustrated within dashed circle 2B.

FIG. 2B illustrates an enlarged view of a portion of the sand trap 210A shown within dashed circle 2B in FIG. 2A. In this embodiment, the liner assembly 222A includes a first layer 230A and a second layer 232A positioned adjacent to the first layer 230A. In one embodiment, the first layer 230A is positioned directly on the substrate 218A. Alternatively, the first layer 230A can be indirectly positioned on the substrate 218A such that one or more other layers (not shown) are positioned between the first layer 230A and the substrate 218A.

The extent to which the first layer 230A covers the surface area of the substrate 218A (within the cavity of the sand trap 210A) can vary. For example, in one embodiment, the first layer 230A covers at least approximately 10% of the substrate 218A. In non-exclusive, alternative embodiments, the first layer 230A covers at least approximately 25%, 50%, 75%, 90% or 100% of the substrate 218A.

In one embodiment, the first layer 230A is formed at least partially from a water-permeable fabric material. In one non-exclusive embodiment, the first layer 230A can be formed from or can include a geosynthetic material such as a geotextile or any other suitable material that resists biological degradation, for example. Alternatively, the first layer 230A can be formed using another type of material that may not resist biological degradation, as appropriate. One representative material that can be used for the first layer 230A includes Mirafi® Filterweave® 404. However, the inclusion of this specific material is not intended to limit the scope of the present invention in any manner, as numerous somewhat similar water-permeable materials can be used for the first layer 230A of the liner assembly 222A. The first layer 230A can be positioned on the substrate 218A and pinned, stapled, adhered or otherwise held in place on the substrate 218A within the cavity 13 of the sand trap 210A. Alternatively, the first layer 230A is simply laid into the cavity 13 without using any type of fastener to hold the first layer 230A in place.

In accordance with one embodiment of the liner assembly 222A, the second layer 232A is formed from a substantially water-impermeable material that is secured to the first layer 230A so that the first layer 230A is positioned between the substrate 218A and the second layer 232A. In an alternative embodiment (not shown), the second layer 232A is indirectly secured to the first layer 230A so that one or more other layers are positioned directly between the first layer 230A and the second layer 232A.

In one embodiment, the second layer 232A can be seamlessly applied as a liquid to the first layer 230A. For instance, the second layer 232A can be sprayed onto the first layer 230A using a compression spray apparatus or other similar type of spraying apparatus, a brush or roller, or by being poured or cast in place, as non-exclusive examples. In this manner, the second layer 232A can adhere to the first layer 230A upon curing of the second layer 232A to form a seamless liner assembly 222A. Stated another way, the first layer 230A can act as a base layer to which the second layer 232A can adequately bond.

The extent to which the second layer 232A covers the surface area of the first layer 230A (facing away from the substrate 218) can vary. For example, in one embodiment, the second layer 232A covers at least approximately 10% of the first layer 230A. In non-exclusive, alternative embodiments, the second layer 232A covers at least approximately 25%, 50%, 75%, 90% or 100% of the first layer 230A.

The thickness of the second layer 232A can be varied depending upon the design requirements of the liner assembly 222A, including the desired flexibility, strength, materials used, slope, etc. In one embodiment, the thickness can be between 5-100 mils. In another embodiment, the thickness can range between 10-75 mils. In yet another embodiment, the thickness can range between 20-60 mils. In still another embodiment, the thickness can be approximately 40 mils. However, in an alternative embodiment, the thickness can be outside of the foregoing ranges.

The permeable nature of the first layer 230A can also facilitate a more integrative adherence between the second layer 232A and the first layer 230A by allowing the liquid-applied second layer 232A to penetrate any pores, cavities or other openings in the first layer 230A. In an alternative embodiment, the second layer 232A is applied as a flexible or a relatively inflexible solid material, which can be heat-bonded or secured in another manner to the first layer 230A.

The material used to form the second layer 232A can vary depending upon the design requirements of the sand trap 210A and the liner assembly 222A. For example, the second layer 232A can include any one of a number of different types of plastic material. In one embodiment, the second layer 232A includes a material that is initially applied as a liquid, such as a PCS-320 Rapid Cure Aromatic Flexible Polyurea manufactured by Polyurea Coating Systems, Inc. This material then cures relatively quickly while achieving a certain level of flexibility to resist punctures or breaches by subterranean vegetation. Thus, any vegetation growing below the surface of the sand trap 210A is inhibited from reaching the surface, and thereby does not become visible to golfers.

In one embodiment, the polyurea material can be derived from the reaction product of an isocyanate component and a resin blend component. The isocyanate can be aromatic or aliphatic in nature. It can be a monomer, polymer, or any variant reaction of isocyanates, a quasi-prepolymer or a prepolymer. As non-exclusive examples, the prepolymer, or quasi-prepolymer, can be made of an amine-terminated polymer resin, or a hydroxyl-terminated polymer resin. Although the polyurea material is described in some detail herein, this level of detail is not intended to be construed as limiting the second layer 232A to the polyurea material. For instance, materials other than polyurea, such as various plastics, resins, polyelastomers, epoxies or other suitable materials can be utilized with the present invention.

In one embodiment, aggregate material can be added to the second layer 232A while the second layer 232A is still in liquid form so that the aggregate is integrally formed as part of the second layer 232A. The addition of aggregate can occur prior to application of the second layer 232A, or soon after application of the second layer 232A into the cavity of the sand trap 210A. The size and type of aggregate that can be added to the second layer 232A can vary. In one embodiment, the aggregate can include sand, quartz, crushed granite or other relatively small types of aggregate that will not excessively increase the thickness or decrease the flexibility of the second layer 232A.

Because the second layer 232A is substantially water-impermeable, any water that enters the sand trap 210A from irrigation or precipitation will permeate the sand 216A, and move by gravity flow to the second layer 232A of the liner assembly 222A. The second layer 232A then directs the water toward the drainage system 220A so that the water can filter through the drain surround 224A (if applicable) and enter the interior of one of the drain lines 226A to exit the sand trap 210A.

Additionally, in the embodiment illustrated in FIGS. 2A and 2B, the liner assembly 222A extends substantially horizontally beyond the perimeter of the sand trap 210A, beneath the ground surface 214A (illustrated in FIG. 2A). Stated another way, a portion of the liner assembly 222A is positioned within the substrate 218A. With this design, any water that penetrates the ground surface 214A near the perimeter 212A of the sand trap 210A can be directed by the liner assembly 222A toward the drainage system 220A. Additionally, this design inhibits potential damage to the edges of the liner assembly 222A by sandwiching the liner assembly 222A within the substrate 218A for protection against UV exposure, damage by golfers, etc.

The liner assembly 222A can extend within the substrate 218A for any suitable distance. In one embodiment, the liner assembly 222A can extend in this manner for approximately 6-24 inches, although the distance can be greater or less than the distances within this range.

Figure 2C:
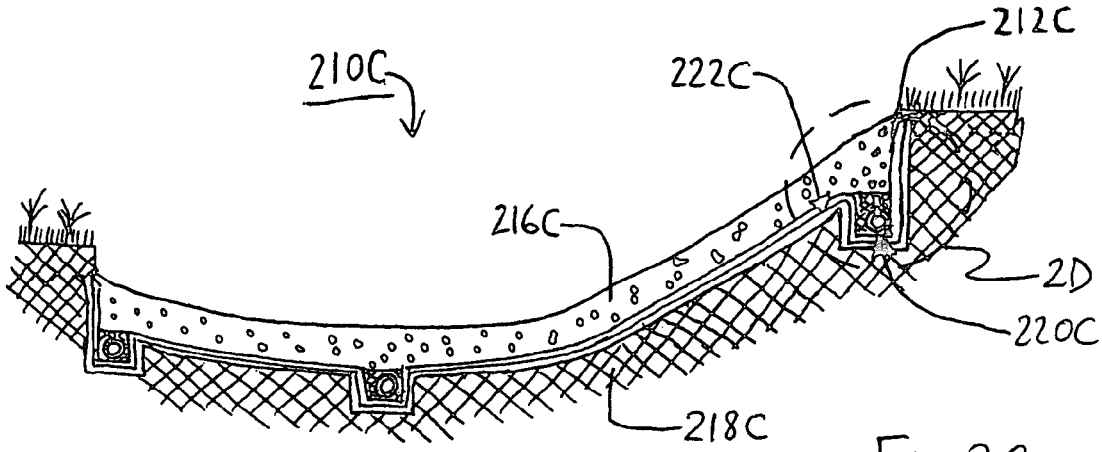
FIG. 2C is a cross-sectional view taken on line 2-2 in FIG. 1, illustrating a second embodiment of a liner having features of the present invention.

FIG. 2C is a cross-sectional view of another embodiment of the sand trap 10 and a portion of the ground surface 14 taken on line 2-2 in FIG. 1. In this embodiment, the sand trap 210C includes a perimeter 212C, sand 216C, a substrate 218C, a drainage system 220C and a liner assembly 222C. In the embodiment illustrated in FIG. 2C, the liner assembly 222C extends along the bottom and sides of the sand trap 210C approximately following the contour of the perimeter 212C of the sand trap 210C.

Figure 2D:
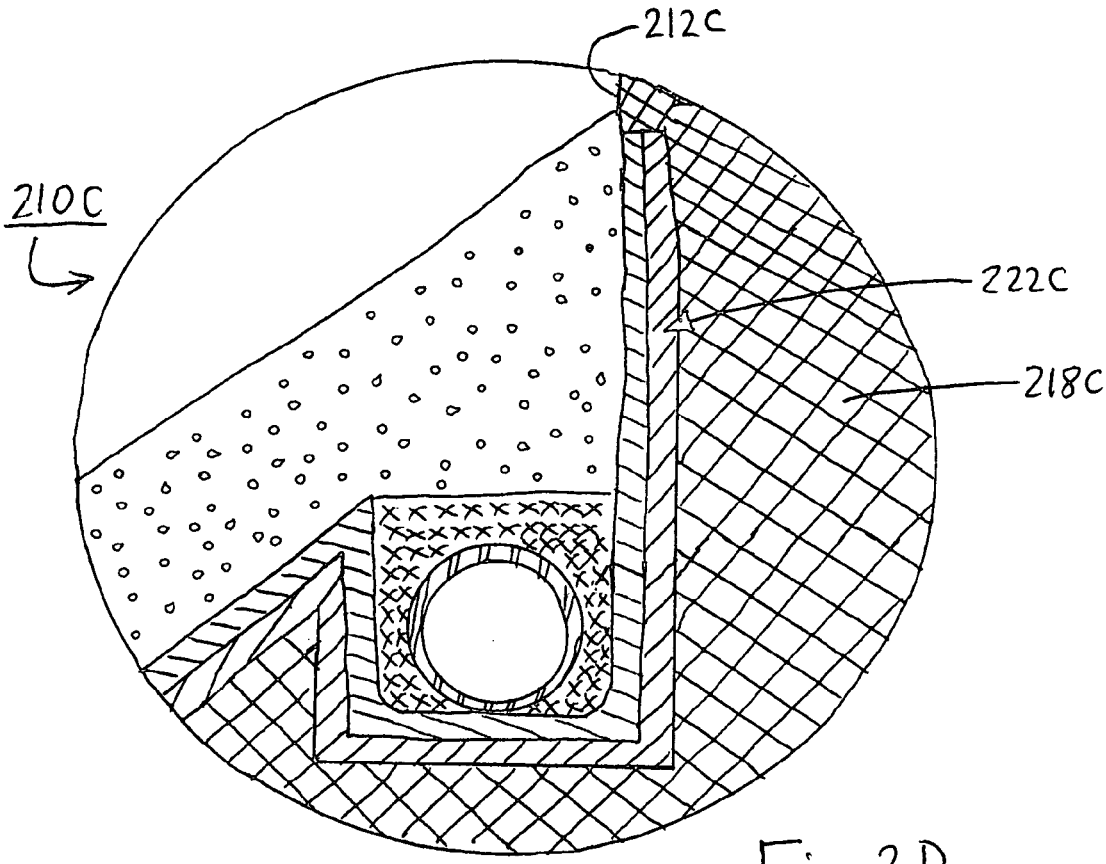
FIG. 2D is a detailed view of a portion of FIG. 2C illustrated within dashed circle 2D.

FIG. 2D illustrates an enlarged view of a portion of the sand trap 210C shown in dashed circle 2D in FIG. 2C. In this embodiment, the liner assembly 222C is substantially similar to the liner assembly 222A illustrated in FIGS. 2A and 2B, with the following distinction. In the embodiment illustrated in FIG. 2C, the liner assembly 222C extends along the bottom and sides of the sand trap 210A, but does not extend in a substantially horizontal direction beyond the perimeter 212C of the sand trap 210C. In other words, a portion of the liner assembly 222C is not sandwiched within the substrate 218C, as illustrated in FIGS. 2A and 2B. Instead, the liner assembly 222C terminates at or near the perimeter 212C of the sand trap 210C.

Figure 3:
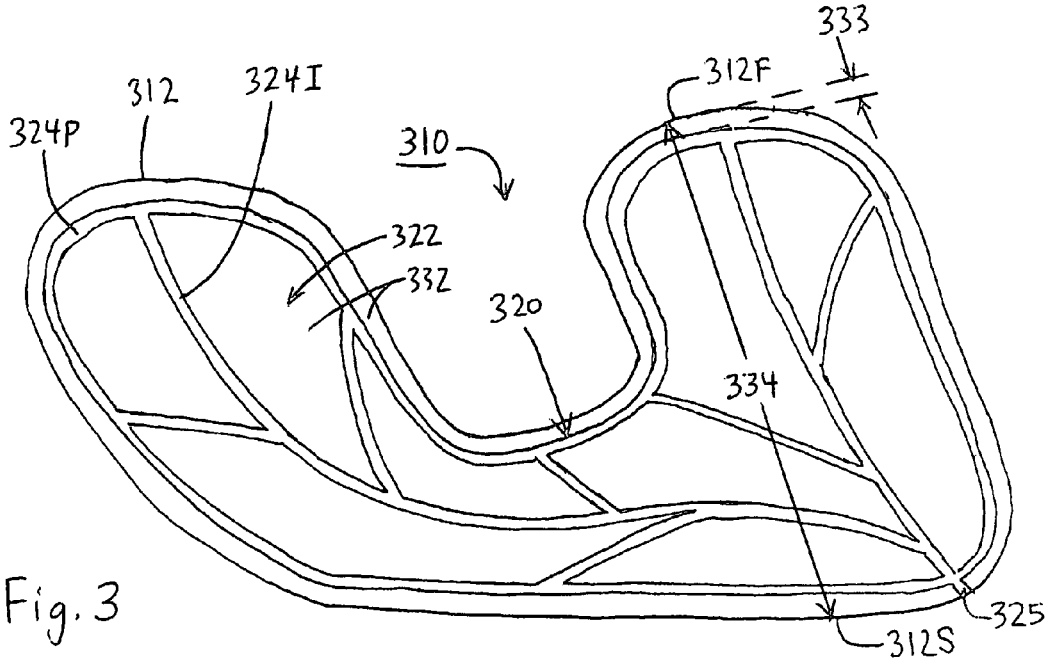
FIG. 3 is a top view of the sand trap with the sand omitted to show the drainage system and a portion of the liner assembly.

FIG. 3 illustrates a schematic diagram of a portion of a sand trap 310 having features of the present invention. In the embodiment illustrated in FIG. 3, the sand has been omitted to show a portion of the drainage system 320 and a portion of the liner assembly 322 (only a portion of the second layer 332 is visible in FIG. 3). The drainage system 320 illustrated in FIG. 3 has a plurality of interconnected drain lines that include a drain outlet 325, one or more interior drain lines 324I and one or more perimeter drain lines 324P. It is recognized that the configuration of the drain lines 324I, 324P illustrated in FIG. 3 is merely one example of a drainage network, and that any number of configurations would satisfy the intent of the present invention.

In this embodiment, the perimeter drain line 324P is positioned substantially along or near the perimeter 312 of the sand trap 310. Typically, the perimeter 312 of the sand trap 310 has the greatest degree of slope, which normally induces irrigation water or precipitation to travel downward toward the middle, less sloped areas of the sand trap 310, where water can migrate and/or percolate, resulting in ponding. However, the perimeter drain line 324P, either alone or coupled with the liner assembly 322 can inhibit this water migration by causing the water to drain via the drainage system 320 more quickly than with conventional sand traps.

In one embodiment, the perimeter drain line 324P is positioned within a horizontal distance 333 of approximately one foot of the perimeter 312 of the sand trap 310. Alternatively, the horizontal distance 333 can be less than or greater than one foot.

In another embodiment, the horizontal distance 333 is a function of the overall dimensions of the sand trap 310. For example, the perimeter drain line 324P is positioned less than a predetermined percentage of a distance 334 across the sand trap 310 away from the perimeter 312, as measured perpendicularly relative to the perimeter 312. Thus, in one embodiment, if the sand trap 310 has a distance 334 measured perpendicularly from a perimeter first side 312F, toward a perimeter second side 312S of the sand trap 310 (not necessarily perpendicular at the perimeter second side 312S) of 20 feet, the perimeter drain line 324P is positioned from the perimeter first side 312F at a horizontal distance that is not greater than a predetermined percentage of 20 feet. In non-exclusive, alternative embodiments, the predetermined percentage is less than approximately 1%, 2%, 5%, 10%, 15% or 20%. Further, in one or more of these embodiments, the perimeter drain line 324P extends along at least approximately 10%, 25%, 50%, 75%, 90% or 100% of the entire perimeter 312 of the sand trap 310.

Figure 4:
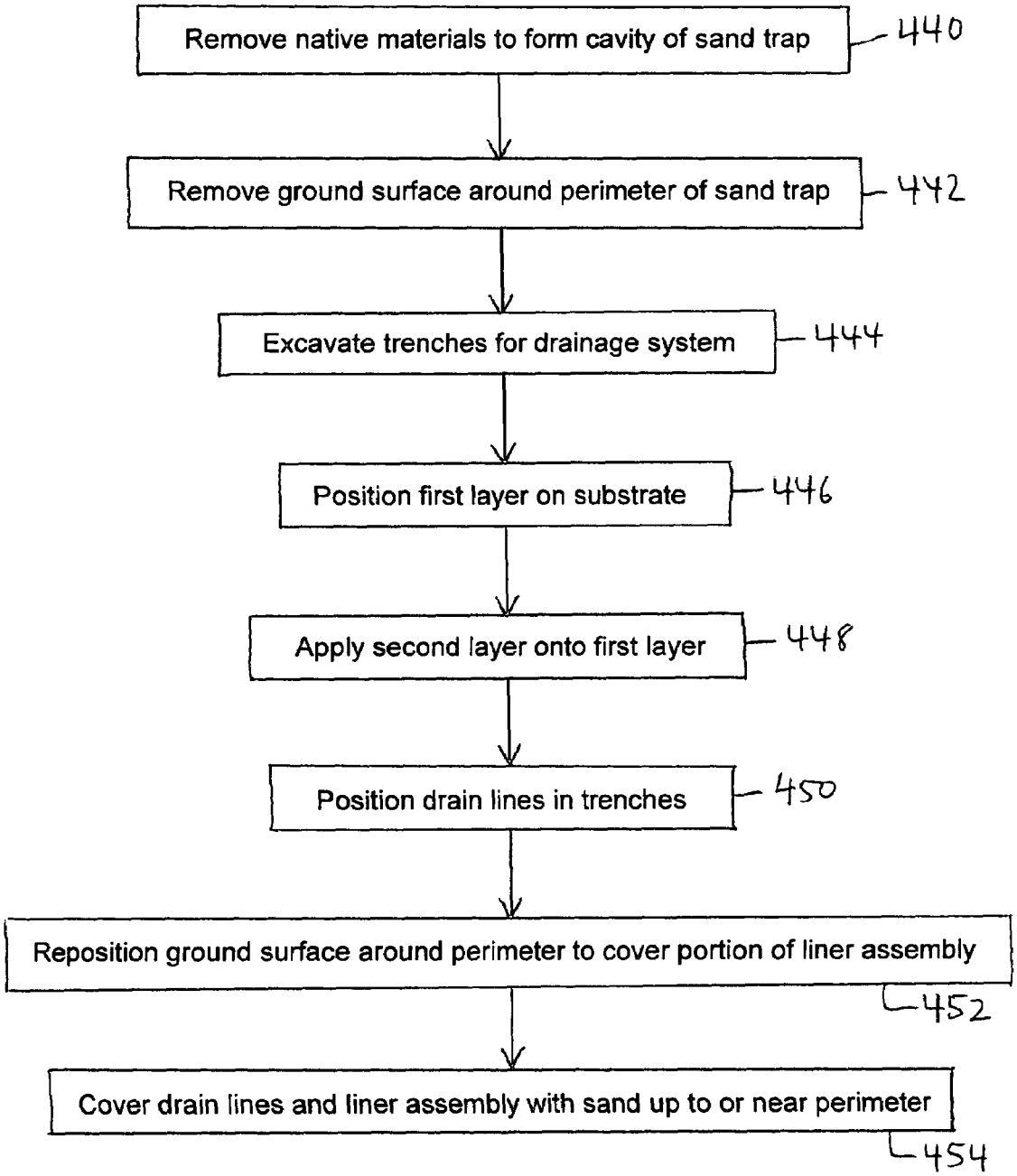
FIG. 4 is a flow chart describing a first embodiment of a method for constructing at least a portion of the sand trap.
Figure 5:
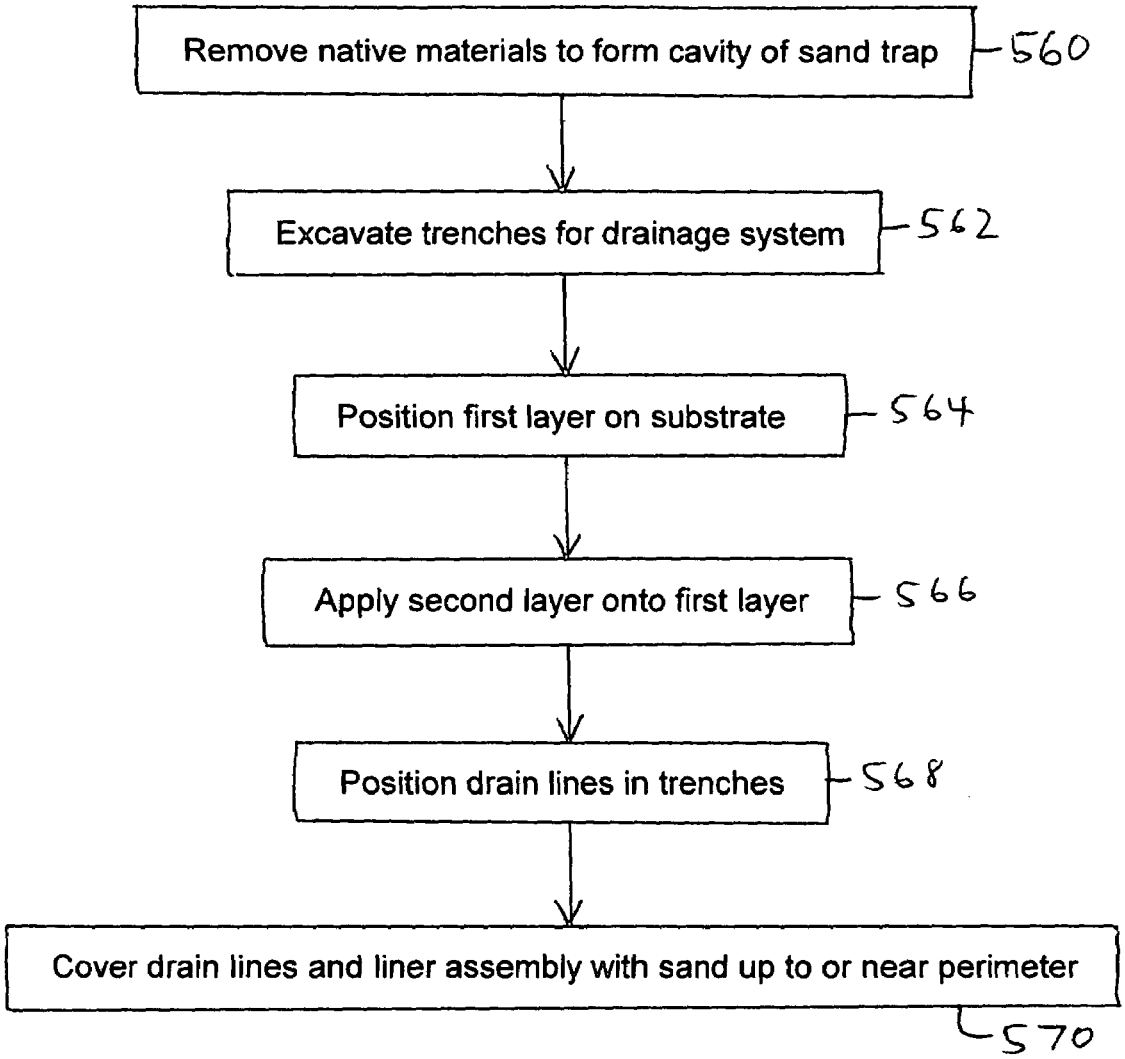
FIG. 5 is a flow chart describing a second embodiment of a method for constructing at least a portion of the sand trap.

FIG. 4 is a flow chart that outlines one embodiment of a method for installing a sand trap including a liner assembly having features of the present invention. It is recognized that the steps provided in the Figures can be reorganized or transposed to suit the design requirements for the sand trap, and that the representative embodiments outlined in FIGS. 4 and 5 are provided for ease of discussion and are not intended to limit the scope of the methods embraced by the present invention.

At step 440, native materials are removed to form a cavity to house the contents of the sand trap as explained previously. Alternatively, materials can be imported to form a substrate and a ground surface that defines the cavity.

At step 442, the ground surface around the perimeter of the sand trap is temporarily removed. The extent of this removal can vary. In various embodiments, the ground surface can be removed by several inches up to several feet in a direction perpendicular to the perimeter of the sand trap. The depth of the removal can also vary. In one embodiment depth of the ground surface that is removed can be from approximately one inch up to approximately six inches or more. This material that is removed can be temporarily stored for replacement, or can be discarded.

At step 444, trenches are excavated within the cavity of the sand trap for the drainage system. The extent of the trenching is dependent upon the configuration of the sand trap, as well as environmental factors such as climate and degree of irrigation. The network of trenches is consistent with the positioning of the drain lines as set forth herein.

At step 446, the first layer of the liner assembly is positioned over the substrate and into the trenches. The first layer can be a single continuous layer of material, or the first layer can consist of multiple sheets or sections of material that are secured together. The first layer extends along the substrate beyond to the original perimeter of the sand trap to cover at least a portion of the substrate that is now exposed due to removal of the ground surface around the perimeter as described in step 442.

At step 448, the second layer of the liner assembly is applied to the first layer to the extent described herein. This application can be accomplished by using a spray gun to apply liquid material forming the second layer, or it can be accomplished in a more manual fashion by brushing, rolling or otherwise applying the liquid material. For a non-liquid application of the second layer, the second layer can be rolled or laid out. As part of this application, the second layer can be heat-treated to bond with the first layer, although this is not essential to the invention, particularly if a liquid-applied second layer is utilized.

At step 450, the drain lines are positioned within the drainage trenches. As part of this step, crushed rock or other aggregate can be used as a drainage surround to act as a filter and as a point of lesser resistance for the drainage system, to attract water to the drain lines. The drain lines are positioned and connected so that a relatively consistent (or positive) slope is maintained to drain the water toward a drain outlet.

At step 452, the ground surface that was previously removed is repositioned over at least a portion of the liner assembly so that the original perimeter of the sand trap is achieved and maintained.

At step 454, sand is added to the sand trap to cover the drainage system and the liner assembly up to or near the perimeter of the sand trap. The second layer of the liner assembly provides a surface to which the sand is more likely to adhere, thereby allowing the sand to remain in place despite a relatively steep slope near the perimeter of the sand trap, in certain locations.

FIG. 5 is a flow chart that outlines another embodiment of a method for installing a sand trap including a liner assembly having features of the present invention. At step 560, native materials are removed to form a cavity to house the contents of the sand trap as explained previously. Alternatively, materials can be imported to form a substrate and a ground surface that defines the cavity.

At step 562, trenches are excavated within the cavity of the sand trap for the drainage system. The extent of the trenching is dependent upon the configuration of the sand trap, as well as environmental factors such as climate and degree of irrigation. The network of trenches is consistent with the positioning of the drain lines as set forth herein.

At step 564, the first layer of the liner assembly is positioned over the substrate and into the trenches. The first layer can be a single continuous layer of material, or the first layer can consist of multiple sheets or sections of material that are secured together. The first layer is positioned up to or near the perimeter of the sand trap.

At step 566, the second layer of the liner assembly is applied to the first layer as described previously herein. This application can be accomplished by using a spray gun to apply liquid material forming the second layer, or it can be accomplished in a more manual fashion by brushing, rolling or otherwise applying the liquid material. For a non-liquid application of the second layer, the second layer can be rolled or laid out. As part of this application, the second layer can be heat-treated to bond with the first layer, although this is not essential to the invention, particularly if a liquid-applied second layer is utilized.

At step 568, the drain lines are positioned within the drainage trenches. As part of this step, crushed rock or other aggregate can be used as a drainage surround to act as a filter and as a point of lesser resistance for the drainage system, to attract water to the drain lines. The drain lines are positioned and connected so that a relatively consistent (or positive) slope is maintained to drain the water toward a drain outlet.

At step 570, sand is added to the sand trap to cover the drainage system and the liner assembly up to or near the perimeter of the sand trap. The second layer of the liner assembly provides a surface to which the sand is more likely to adhere, thereby allowing the sand to remain in place despite a relatively steep slope near the perimeter of the sand trap, in certain locations.

While the particular sand trap 10, liner assemblies 222A, 222C and methods for constructing a sand trap 10 as herein shown and disclosed in detail are fully capable of obtaining the objects and providing the advantages herein before stated, it is to be understood that they are merely illustrative of some of the presently preferred embodiments of the invention and that no limitations are intended to the details of construction or design herein shown other than as described in the appended claims.

What is claimed is:

1. A method for constructing a sand trap, the method comprising the step of:

positioning a water-permeable first layer within a cavity of the sand trap between a substrate and a substantially water-impermeable second layer that is at least partially formed from an aggregate material, the substrate being formed from one of soil or rock.

2. The method of claim 1 wherein the first layer includes a geotextile material.

3. The method of claim 1 where the second layer is applied directly onto the first layer.

4. The method of claim 1 wherein the second layer is applied in a liquid form directly onto the second layer.

5. The method of claim 1 wherein at least one of the layers is positioned to extend within the substrate outside of a perimeter of the sand trap.

6. The method of claim 1 wherein the step of positioning includes forming the second layer from a material that includes polyurea.

7. The method of claim 1 wherein the step of positioning includes adhering the second layer to the first layer.

8. A method for constructing a sand trap, the method comprising the step of:

positioning a water-permeable first layer within a cavity of the sand trap; and applying a substantially water-impermeable second layer that is partially in liquid form directly onto the first layer, the second layer including an aggregate material.

9. The method of claim 8 wherein the step of applying including covering at least approximately 25% of the first layer with the second layer.

10. The method of claim 8 wherein the step of positioning includes positioning the first layer to extend within a substrate outside of a perimeter of the sand trap.

11. The method of claim 8 wherein the step of applying includes forming the second layer from a material that includes polyurea.

12. The method of claim 8 wherein the step of applying includes adhering the second layer to the first layer.

13. A liner assembly for a sand trap, the sand trap having a perimeter that defines a cavity and a substrate within the cavity, the liner assembly comprising:

a first layer that is positioned on the substrate, the first layer being water-permeable; and a second layer that is applied to the first layer to cover a majority of the first layer, the second layer being substantially water-impermeable, the second layer including an aggregate material that is integrally formed as part of the second layer.

14. The liner assembly of claim 13 wherein the first layer includes a geotextile material.

15. The liner assembly of claim 13 wherein the second layer is applied to the first layer as a liquid.

16. The liner assembly of claim 13 wherein the second layer includes a polyurea material.

17. The liner assembly of claim 13 wherein the second layer is seamless.

18. The liner assembly of claim 13 wherein the second layer is not directly applied to the substrate.

19. The liner assembly of claim 13 wherein the substrate is formed from soil materials.

20. The liner assembly of claim 13 wherein the first layer covers at least approximately 10% of the substrate within the cavity.

21. The liner assembly of claim 13 wherein the first layer covers at least approximately 75% of the substrate within the cavity.

22. The liner assembly of claim 13 wherein the second layer covers at least approximately 75% of the first layer.

23. The liner assembly of claim 13 wherein at least one of the layers extends within the substrate at least partially outside the perimeter of the sand trap.

24. A sand trap including a drain line and the liner assembly of claim 13 that is at least partially positioned between the substrate and the drain line.

25. The sand trap of claim 24 wherein the drain line runs within approximately one foot of the perimeter over at least approximately 50% of the length of the perimeter.

26. A liner assembly for a sand trap, the sand trap having a perimeter that defines a cavity, and a substrate within the cavity of the sand trap, the liner assembly comprising:

a first layer that at least partially covers the substrate; and a second layer including a liquid material that is applied to the first layer, the second layer being substantially water-impermeable, the second layer including an aggregate material that is integrally formed as part of the second layer.

27. The liner assembly of claim 26 wherein the first layer includes a geotextile material.

28. The liner assembly of claim 26 wherein the second layer includes a polyurea material.

29. The liner assembly of claim 26 wherein the second layer is not directly applied to the substrate.

30. The liner assembly of claim 26 wherein the first layer covers at least approximately 25% of the substrate within the cavity.

31. The liner assembly of claim 26 wherein the second layer covers at least approximately 25% of the first layer.

32. The liner assembly of claim 26 wherein at least one of the layers extends within the substrate outside the perimeter of the sand trap.

33. The liner assembly of claim 26 wherein each of the layers extends within the substrate outside the perimeter of the sand trap.

34. A sand trap including a drain line and the liner assembly of claim 26 that is at least partially positioned between the substrate and the drain line.

* * * * *